United States Patent [19]

Weeks et al.

[11] Patent Number: 4,780,007

[45] Date of Patent: Oct. 25, 1988

[54] RECORD MEDIA THICKNESS COMPENSATING MECHANISM

[75] Inventors: David E. Weeks, Newfield; Robert L. Wirth, Ithaca; Winston B. Ferguson, Ithaca; Kenneth W. Hanna, Ithaca, all of N.Y.

[73] Assignee: NCR Corporation, Dayton, Ohio

[21] Appl. No.: 67,757

[22] Filed: Jun. 29, 1987

[51] Int. Cl.[4] ..... B41J 11/20

[52] U.S. Cl. ..... 400/56; 400/58

[58] Field of Search ..... 400/55, 56, 57, 58, 400/59

[56] References Cited

U.S. PATENT DOCUMENTS

| | | | |
|---|---|---|---|
| 2,839,176 | 6/1958 | Metzner et al. | 400/616.3 |
| 3,154,184 | 10/1964 | Gallant et al. | 400/58 X |
| 3,461,797 | 8/1969 | Trab et al. | 400/58 X |
| 3,912,068 | 10/1975 | Kwan et al. | 400/56 |
| 4,024,940 | 5/1977 | Hendrischk et al. | 400/56 |
| 4,143,977 | 3/1979 | Kurihara et al. | 400/56 |
| 4,184,780 | 1/1980 | Kurihara et al. | 400/56 |
| 4,189,244 | 2/1980 | Harrison | 400/55 |
| 4,210,076 | 7/1980 | Yamamoto et al. | 400/59 X |
| 4,222,673 | 9/1980 | Plaza et al. | 400/56 |
| 4,227,819 | 10/1980 | Manriquez | 400/56 |
| 4,365,900 | 12/1982 | Gottsmann et al. | 400/58 X |
| 4,422,782 | 12/1983 | Lawter et al. | 400/56 |
| 4,514,101 | 4/1985 | Smith | 400/59 |
| 4,589,784 | 5/1986 | Valle et al. | 400/56 |
| 4,632,577 | 12/1986 | Brull et al. | 400/56 |

FOREIGN PATENT DOCUMENTS

| | | | |
|---|---|---|---|
| 152975 | 9/1982 | Japan | 400/56 |

*Primary Examiner*—Charles Pearson

*Attorney, Agent, or Firm*—Wilbert Hawk, Jr.; Albert L. Sessler, Jr.; George J. Muckenthaler

[57] ABSTRACT

A mechanism for compensating for different thicknesses of record media at a printing station utilizes a platen assembly which is coupled with a pivotable arm structure to move the platen assembly toward and away from the print head. The pivotable arm structure is swung in an eccentric manner relative to the center of the platen assembly to move the platen in a linear path to accommodate the record media.

18 Claims, 7 Drawing Sheets

RECORD MEDIA THICKNESS COMPENSATING MECHANISM

BACKGROUND OF THE INVENTION

In the field of printing, the most common type printer has been the printer which impacts against record media that is moved past a printing line or line of printing. As is well-known, the impact printing operation depends upon the movement of impact members, such as print hammers or wires or the like, which are typically moved by means of an electromechanical drive system and which system enables precise control of the impact members.

In the field of dot matrix printers, it has been quite common to provide a print head which has included therein a plurality of print wire actuators or solenoids arranged or grouped in a manner to drive the respective print wires a very short, precise distance from a rest or non-printing position to an impact or printing position. The print wires are generally either secured to or engaged by the solenoid plunger or armature which is caused to be moved such precise distance when the solenoid coil is energized and wherein the plunger or armature normally operates against the action of a return spring.

It has also been quite common to provide an arrangement or grouping of such solenoids in a circular configuration to take advantage of reduced space available in the manner of locating the print wires in that specific area between the solenoids and the front tip of the print head adjacent the record media. In this respect, the actuating ends of the print wires are positioned in accordance with the circular arrangement and the operating or working ends of the print wires are closely spaced in vertically aligned manner adjacent the record media. The availability of narrow or compact actuators permits a narrower or smaller print head to be used and thereby reduces the width of the printer because of the reduced clearance at the ends of the print line. The print head can also be made shorter because the narrow actuators can be placed in side-by-side manner closer to the record media for a given amount of wire curvature.

In the wire matrix printer which is utilized for receipt and journal printing operation, the print head structure may be a multiple element type and horizontally disposed with the wire elements aligned in a vertical line and supported on a print head carriage which is caused to be moved or driven in a horizontal direction for printing in line manner across the receipt or journal paper and wherein the drive elements or transducers may be positioned in a circular configuration with the respective wires leading to the front tip of the print head. In another arrangement of a wire matrix printer which is utilized for business forms or like record media printing operation, the print head may be oriented in a manner wherein the nose is pointed downward for printing on the form, slip or like media while the carriage and print head are moved above and across the form or media in the horizontal direction.

Further, the printer structure may be an arrangement which includes a plurality of equally-spaced, horizontally-aligned, single element print heads which are moved in back and forth manner to print successive lines of dots in making up the lines of characters. In this latter arrangement, the drive elements or transducers are individually supported along a line of printing. Dependent upon the printer type, the horizontally-aligned, single element print heads may be either horizontally or vertically oriented in the axial direction for printing operation. These single wire actuators or solenoids are generally tubular or cylindrically shaped and include a shell which encloses a coil, an armature and a resilient member arranged in manner and form wherein the actuator is operable to cause the print wire to be axially moved a small precise distance in dot matrix printing.

In the case of a wire matrix printer which is utilized for form or multi-copy printing, the difference in thickness of the forms or copies may require some means or mechanism for adjusting the gap or increasing the distance between the print head and the printer platen. It is in the field of business forms or like record media of different thicknesses that the subject matter of the present invention is most closely associated and which provides for improved and advantageous positioning and control of such forms during the printing operation. It is desirable that a positive method of forms compensation be provided regardless of the thickness of the form.

Representative documentation in the field of wire matrix print heads used for printing forms or like record media includes U.S. Pat. No. 2,839,176, issued to A. W. Metzner et al. on June 17, 1958, which discloses an adjustable platen roll which is supported at each end by a pin wheel body that is rotatably mounted on a bearing in the form of a bushing having a cylindrical enter surface and an eccentric bore.

U.S. Pat. No. 3,154,184, issued to R. R. Gallant et al. on Oct. 27, 1964, discloses platen adjusting means for typewriters wherein the platen is seated upon saddlers of part-circular saddle elements each of which have a peripheral face in an eccentric relationship to the centers of the saddlers.

U.S. Pat. No. 3,461,797, issued to A. C. Trab et al. on Aug. 19, 1969, discloses an eccentrically mounted platen structure in selective printing machines wherein the platen is eccentrically journaled in a pair of continuously rotating end disks so as to perform a cycloidal motion parallel to itself under control of a planetary gear system of the same eccentricity.

U.S. Pat. No. 3,912,068, issued to O. Kwan et al. on Oct. 14, 1975, discloses a printer having a document thickness compensating device wherein the spring-mounted platen is moved into position to clamp the document with substantially uniform pressure against elongated surfaces, and a document holding assembly includes a slot with control of document movement to position the document for printing.

U.S. Pat. No. 4,024,940, issued to W. Hendrischk et al. on May 24, 1977, discloses a matrix printer having a document thickness compensating device wherein a roller on the print head runs on a resilient rail urged against the platen and the roller can be retracted by pivoting the rail carrier under engagement of a second rail cooperating with a second roller on the head.

U.S. Pat. No. 4,143,977, issued to T. Kurihara on Mar. 13, 1979, discloses first and second independently movable platen units arranged to compensate for recording medium thickness, a third platen unit between the first and second units, and first and second springs secured to the first and second units and biasing the third unit toward the print station.

U.S. Pat. No. 4,184,780, issued to T. Kurihara et al. on Jan. 22, 1980, discloses a printer having a platen with separate units movable toward and away from the recording medium by rotary cams and spring means and lockable in position by lever means.

U.S. Pat. No. 4,189,244, issued to G. F. Harrison on Feb. 19, 1980, discloses a platen gap adjuster that has a shaft with offset spindles on a common axis so that rotation of the spindles about the axis causes eccentric rotation of the shaft to displace the print head.

U.S. Pat. No. 4,210,076, issued to Y. Yamamoto et al. on July 1, 1980, discloses printing apparatus with a type carrier movable on a tiltable support structure, position retaining means for the structure, clearance adjusting means depending upon printing medium thickness and cam means providing intervention between the retaining means and the adjusting means.

U.S. Pat. No. 4,222,673, issued to M. G. Plaza et al. on Sept. 16, 1980, discloses a print head carriage having a rotatable manifold member operating in eccentric camming manner to adjust the distance between the print head and the platen for accommodating printing media of various thicknesses.

U.S. Pat. No. 4,227,819, issued to R. F. Manriquez on Oct. 14, 1980, discloses a platen assembly for feeding and holding single or multi-layer record media and having one of a pair of feed rollers pivotally mounted to yieldingly engage and hold both sides of the record media while the platen yieldingly engages and holds the record media against gap determining guides. The platen is free floating with the aid of a pair of coil springs and is raised into engagement with the record media by rotatable cam means.

U.S. Pat. No. 4,422,782, issued to R. L. Lawter et al. on Dec. 27, 1983, discloses a record member feed and support mechanism wherein a control solenoid moves record member drive rollers and a spring urged platen member. Force on the platen compensates for thickness of the record member and spring means are associated with the drive rollers to hold the record member in position.

U.S. Pat. No. 4,514,101, issued to H. E. Smith on Apr. 30, 1985, discloses paper thickness adjusting mechanism including a pair of guide rails and an adjustable marking module movable along the rails. The mechanism uses a toggle bracket to allow the module to pivot about the guide rail relative to the platen.

U.S. Pat. No. 4,589,784, issued to F. Valle on May 20, 1986, discloses a point of sale printer wherein a receipt is guided between the print head and a part of width of the platen and a slip is also guided over the platen. Other documents may be fed upwardly or downwardly between guides and past the print head.

And, U.S. Pat. No. 4,632,577, issued to R. A. Brull et al. on Dec. 30, 1986, discloses record media thickness compensating mechanism wherein the platen is movable toward and away from the print head and the mechanism uses first and second cam members to control the position of the platen.

SUMMARY OF THE INVENTION

The present invention relates generally to impact type printers which have the capability of printing on record media of different thicknesses. More particularly, the present invention relates to means for positioning the printer platen and an associated media drive roller in a manner to compensate for the difference in thickness of several types of record media being used in the printer. The record media may be a single layer sheet or a variety of multilayer forms, any of which may be of different or greater thickness than other media.

A media thickness compensating arm assembly is pivoted from a predetermined position relative to the printing station for supporting the printer platen so as to enable moving the platen in a direction toward and away from the print head. A cam line, operably associated with and forming a part of the overall compensating assembly, is caused to be rotated in one direction to allow insertion of the form or like media in the gap between the platen and the print head, and the cam line is then caused to be rotated further in the same direction to position the platen and the form for printing operation.

More specifically, the forms compensation mechanism converts rotational motion and positioning of the arm assembly into linear motion and positioning of the printer platen. The platen is secured to a platen carrier that is supported and guided by means of slots in side plates of the printer frame. Pins secured to the platen carrier operate in slots in an eccentric cam and link arrangement which is supported and free to rotate in the side plates of the frame.

In view of the above discussions, a principal object of the present invention is to provide mechanism in a printer for compensating for different thicknesses of record media.

Another object of the present invention is to provide camming means rotatable in a manner to enable insertion of record media of different thicknesses.

An additional object of the present invention is to provide mechanism for adjusting the gap for record media inserted between the platen and the print head.

A further object of the present invention is to provide forms compensation mechanism that converts rotary motion and positioning of a compensation arm into linear motion and positioning of the printer platen.

Still another object of the present invention is to provide a platen operably associated with eccentric supporting means for effecting an optimum gap for different thicknesses of record media.

Still another object of the present invention is to provide a self-locking platen mechanism which utilizes friction to resist printing impact forces and thereby maintain the optimum platen and print head gap.

Additional advantages and features of the present invention will become apparent and fully understood from a reading of the following description taken together with the annexed drawing.

DESCRIPTION OF THE PREFERRED EMBODIMENT

Prior to describing the structure in detail, it should be noted that the printer of the present invention is a multi-function type that can accommodate a receipt, a journal and a slip or form which form consists of one or more parts. The printer can be set in one of five different modes of operation which include printing a journal only, printing a receipt only, printing a receipt and a journal, printing a slip or form only, or printing a slip or form and a journal. The journal and the receipt can accommodate 42 columns of printing and the slip or form can accommodate 46 columns of printing.

Figure 1:
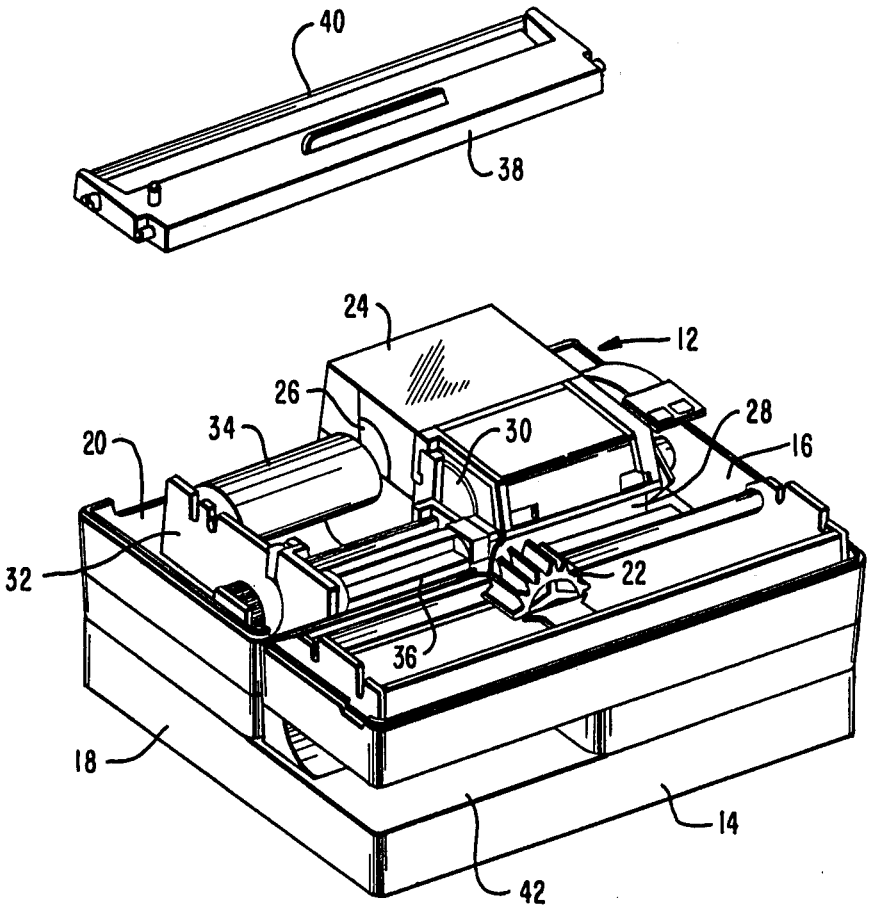
FIG. 1 is a perspective view of a printer incorporating the subject matter of the present invention.

Referring now to the drawing, FIG. 1 shows a perspective view of a printer 12 having a front portion 14, a right side 16, a left side 18, and a rear portion 20. A wire matrix print head 22 is moved in side-to-side manner by suitable drive means (not shown), but located at the right front corner of the printer. A journal station or module 24 is provided at the right hand side of the printer and includes a supply roll 26 of journal paper that is guided past the journal print station platen 28 and is rewound on a take-up roller 30 by a step-type drive motor (not shown).

A receipt station or module 32 is provided at the left hand side of the printer and includes a supply roll 34 of receipt paper that is guided past the receipt print station platen 36 and is driven by a step-type drive motor (not shown). The journal station and the receipt station are separated by six character spaces. A ribbon cassette 38 of the operator-changeable type is positioned to the rear of the print head 22 and the ribbon 40 is driven in one direction from right to left in a path between the print head and the record media (journal, receipt or slip). A slot 42 is provided at the left front side for insertion of the slip which can be inserted from the front of the printer, from the side thereof or from the top in a path in front of the receipt paper at the receipt station.

Figure 2:
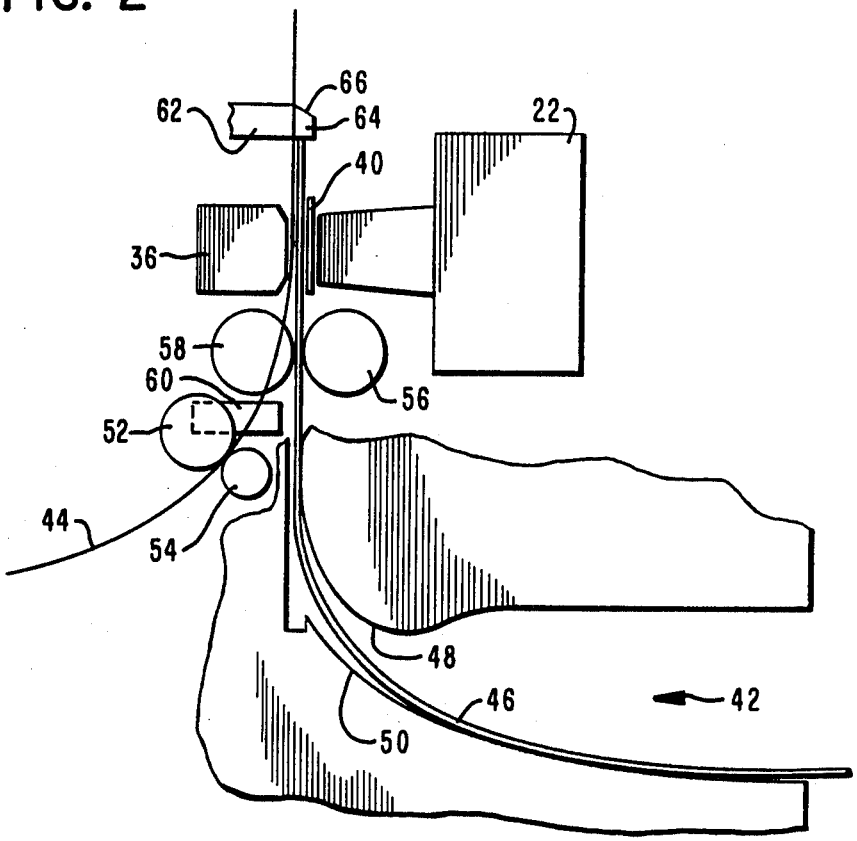
FIG. 2 is a diagrammatic view in side elevation of parts of the printer of FIG. 1.

FIG. 2 illustrates in diagrammatic manner the path of the receipt paper 44 and the path of a slip or form 46 along with guides 48 and 50 for the slip. The receipt paper 44, the slip or form 46 and the ribbon 40 are guided in a path past the printing station which includes the print head 22 and the platen 36.

A drive roller 52 and a pressure roller 54 are positioned to feed the receipt paper 44 from the supply roll 34 to the printing station. A drive roller 56 and a pressure roller 58 are positioned above the receipt feed rollers 52 and 54 to feed the slip or form 46 from the slot 42 at the left front of the printer 12. Such rollers 56 and 58 are also utilized to feed a slip or form past the printing station when the slip or form is inserted from the top or from the left side of the printer 12. The slip or form 46 may be of single part or multiple part construction and a minimum allowable single part form is 15 pounds weight, based on 500 sheets of 17×22 inches paper. A preferred maximum form thickness is 0.019 inches with printing in legible manner on all parts of forms having two, three or four parts.

The slip or form 46, when inserted from the front of the printer 12 through the slot 42, is advanced upwardly by the feed rolls 56 and 58, is sensed by a slip sensor 60 and engages a spring-loaded retractable slip stop 62. A guide rail (not shown) is provided at the right hand side of the slot 42 for contact by the slip 46 to position the slip correctly for printing. The slip stop 62 permits initial positioning of a slip 46 for fixed first or last line printing without the requirement to visually align the slip.

A slip or form 46, when inserted from the side of the printer 12, engages the slip stop 62 which retracts rearward by reason of contact with the slanted or inclined surface 64 thereof. A slip or form 46, when inserted from the top of the printer 12, engages the slip stop 62 and retracts the stop rearward by reason of contact with the slanted or inclined surface 66 thereof.

The various functions of the printer 12 to be more specifically described include feeding or advancing the receipt paper 44 from the supply roll 34 upwardly past the printing station, and opening the slip or form feed rollers 56 and 58 along with contact of the slip or form 46 with the slip stop 62 to allow proper positioning of the slip or form at the print station. Additional functions of the printer 12 to be described in more detail include the automatic forms compensation mechanism for accommodating forms of different thicknesses and the utilization of the slip feed rolls 56 and 58 to advance or retard the form during the printing operations.

Figure 3:
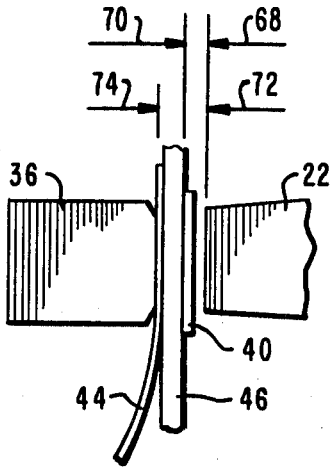
FIG. 3 is an enlarged view of parts of the printer of FIG. 2.

FIG. 3 illustrates a simplified arrangement of the print head 22, the platen 36, a slip or form 46 and the ribbon 40. Typically in the case of a wire matrix type print head, as 22, such print heads provide quality printing over a relatively small range of print head-to-media gap, shown by the arrows 68 and 70. However, when the printer is to be utilized for printing on various multiple-part forms of different thicknesses, it is necessary to vary or adjust the print head-to-platen gap, as indicated by the arrows 72 and 74. It is to be noted that the best operating characteristics of the printer in providing such quality printing are maintained by keeping the print head to record media gap at substantially a constant figure or by decreasing such gap in proportion to the thickness of the slip or form type media. In a preferred arrangement of the present invention, the ideal adjustment or change in the gap is to decrease the gap, as represented by the arrows 68 and 70, by approximately 40 percent of the thickness of the inserted form 46.

Since a feature of the printer 12 of the present invention includes compensation for printing on forms of different thicknesses, the mechanism of the receipt/slip station, as illustrated in FIGS. 4–7, will now be described in detail.

Figure 4:
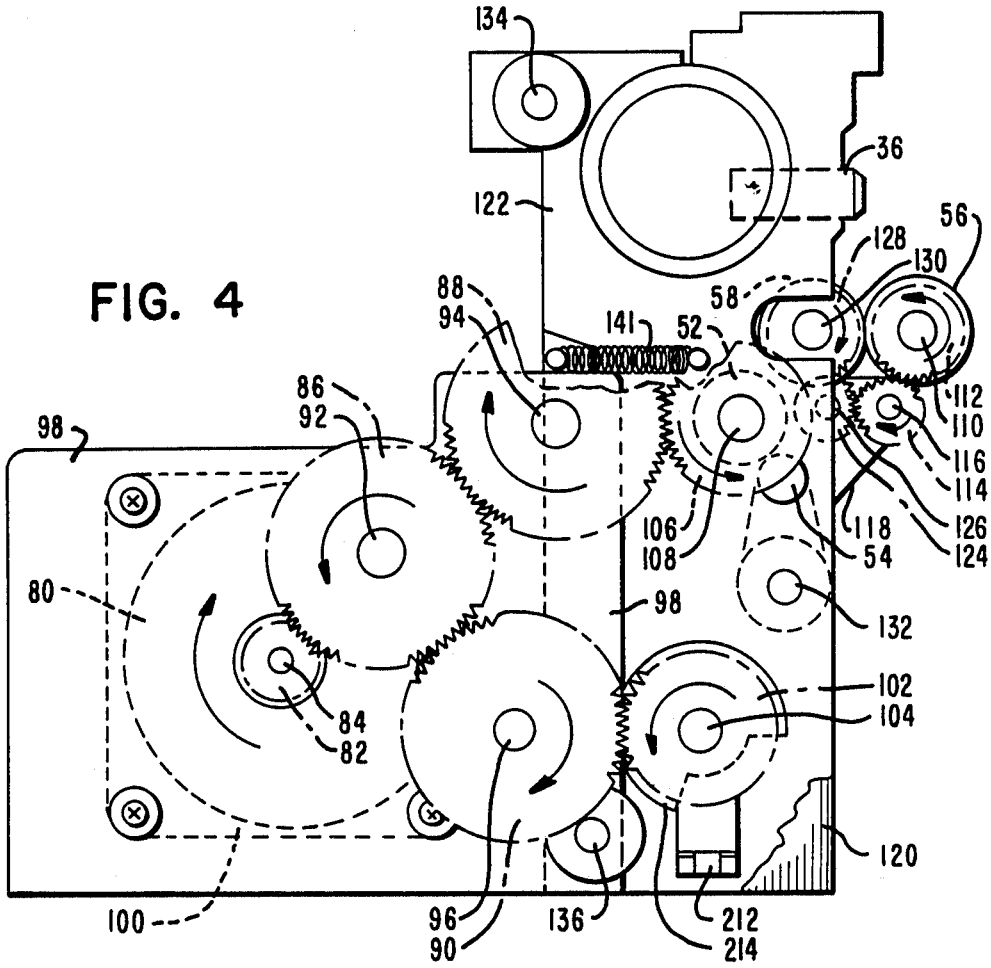
FIG. 4 is a side elevational view of the drive mechanism for the feed rollers of the printer of FIG. 1.

FIG. 4 shows the drive train or arrangement from a permanent magnet type step motor 80 to the slip or form feed rollers 56 and 58. A motor pinion 82 on a shaft 84 meshes with an idler gear 86 carried on a shaft 92, which in turn meshes with another idler gear 88 and with an additional idler gear 90. Idler gear 86 is carried by shaft 92, idler gear 88 is carried by shaft 94, and idler gear 90 by shaft 96. The several shafts 92, 94 and 96 are supported by a plate member 98 which also supports the step motor 80 by means of a motor bracket 100. The idler gear 90 meshes with an input gear 102 carried on a cam shaft 104, the operation of which will be described later.

The idler gear 88 meshes with an input gear 106 carried on a shaft 108. The shaft 108 also carries the receipt feed roller 52 which is a rubber-faced roller with which the metallic spring-loaded pressure roller 54 is in contact with to feed the receipt paper 44.

The slip feed roller 56 is carried on a shaft 110 extending substantially the width of the printer and includes a gear 112 positioned on the shaft at a location between the journal station and the receipt station. The shaft is driven through a suitable gear train (not shown) from a step motor (also not shown) that is located in the right front corner of the printer. The gear 112 meshes with an idler or transfer gear 114 carried on a shaft 116 that is journaled on a bracket 118 of the right hand side plate 120. A left hand side plate 122 provides suitable journals for the shafts 104 and 108 and the right hand side plate 120 likewise provides suitable journals for such shafts. A second idler or transfer gear 124 is carried on a shaft 126 that is also journaled on the bracket 118 of the side plate 120 and such gear 124 meshes with and is driven by the gear 114. The transfer gear 124 meshes with and drives a gear 128 that is secured on the right hand end of a shaft 130 that carries the slip feed pressure rollers 58 near the ends of the shaft. A pivot shaft 132 is supported by the side plates 120 and 122 which plates are spaced apart and secured by elongated pins 134 and 136.

Figure 5:
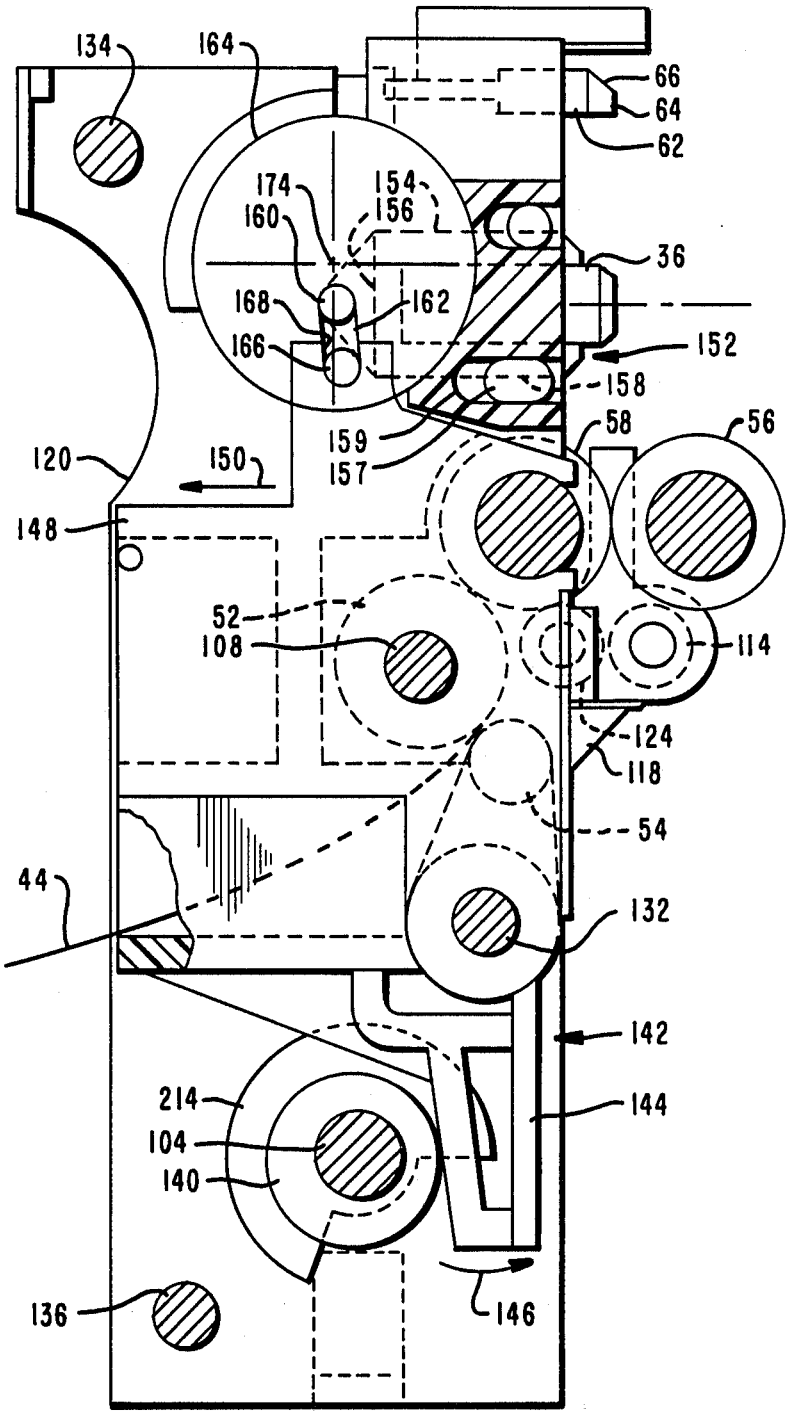
FIG. 5 is a side elevational view of the parts of the forms compensating mechanism.

FIG. 5 is an enlarged side elevational view of the parts operably associated with the forms compensation mechanism of the present invention. The locations of the slip feed rolls 56 and 58, the transfer drive gears 114 and 124, the receipt paper drive rolls 52 and 54 and the cam and pivot shafts 104 and 132 are shown for orientation purposes in relation to the parts of the forms compensation mechanism.

A forms compensating cam member 140 in the nature of an off-center or eccentric-like arrangement (FIG. 5) is secured to the cam shaft 104 in a location approximately at the middle of the receipt printing station 32, the cam shaft being rotatable through the gear 102 (FIG. 4). A forms compensating arm structure, generally designated as 142, is pivoted on shaft 132 and includes portions extending generally upwardly and downwardly from the shaft. A downwardly extending portion 144 is engageable by the cam member 140 to be swingable on the shaft 132 to the right in FIG. 5, as indicated by the arrow 146, and an upwardly extending portion 148 is swingable about the shaft to the left, as indicated by the arrow 150. The forms compensating arm structure 142 is biased in a clockwise direction by a pair of extension springs, one shown at 141 (FIG. 4), to maintain the platen 36 in a desired position and to force the pressure rollers 58 against the feed rollers 56.

The platen 36 is supported by means of a platen carrier 152 comprising a plate-like housing of generally U-shaped configuration and including top 154, rear 156 and bottom 158 portions, the top portion 154 and the bottom portion 158 having projecting edges 157 (FIG. 6) slidable in suitable slots 159 in the side plates 120 and 122 of the receipt module 32 to accommodate fore-and-aft movement of the platen. The platen carrier 152 includes pins, as at 160, which operate in slots 162 of an eccentric cam member 164. The cam member 164 has pins 166 which operate in slots 168 in the forms compensating arm structure 142. The cam member 164 is supported by and free to rotate in bearings 170 and 172 (FIG. 6) in the side plates 120 and 122. The center of rotation is shown in FIG. 5 at 174 and it is seen that rotation of the forms compensation arm 142 about the shaft 132 causes the cam member 164 to rotate about the center of rotation 174, which action translates the platen carrier 152 and the platen 36 in fore-and-aft direction. The specific construction of the forms compensation arm structure 142 and its relationship with the platen 36 provides for converting rotational motion into linear motion.

Figure 6:
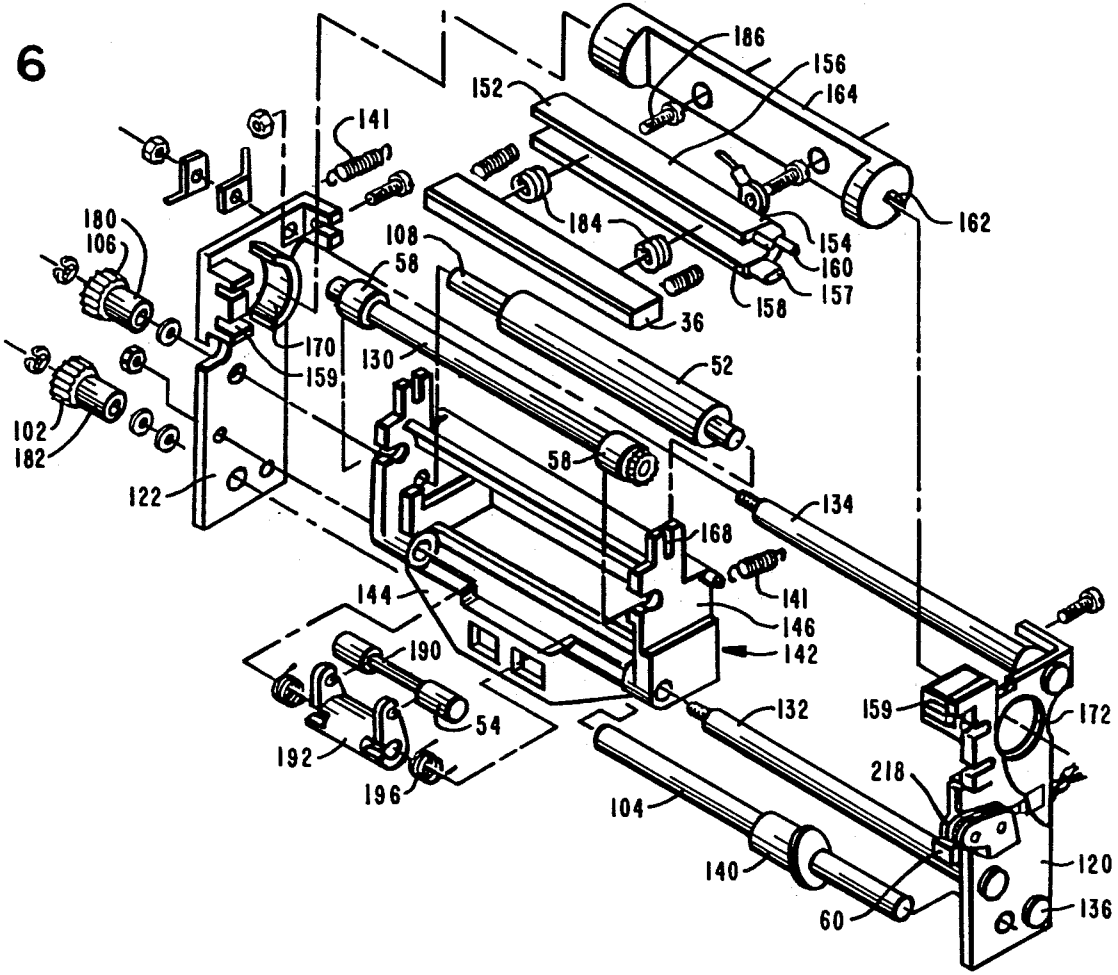
FIG. 6 is an exploded view of the parts of forms compensating mechanism.

FIG. 6 shows an exploded view of the parts making up the forms compensation mechanism of the present invention. The view in FIG. 6 is taken from the right front of the receipt module 32. The gear 106 is coupled to the shaft 108 through a one-way roller-type clutch 180 for rotating the receipt feed roller 52 in one direction. The gear 102 is coupled to the cam shaft 104 through a one-way roller-type clutch 182 for rotating the cam shaft 104. The side plates 120 and 122 of the print station frame are spaced apart and supported by the elongated pins 134 and 136 and by the pivot shaft 132. The forms compensation arm structure 142 includes the lower portion 144 and the upper portion 146 of a specific and irregular-shaped design for accommodating the pivot shaft 132, the receipt roller 52 and shaft 108, and the slip rollers 58 and shaft 130.

The platen 36 is carried by and contained substantially within the carrier 152, it being seen that the platen is of the elongated flat bar type and that the carrier 152 provides a housing for the platen. The platen 36 is loaded by springs, as 184, and secured by screws 186. The platen carrier 152 is operably coupled or linked with the cam member 164 which cam member is generally cylindrically shaped and includes the slots, as 162, for receiving the pins 160 on the platen carrier (FIG. 5). The cam member 164 also includes pins 166 on the ends thereof for operating in the slots, as 168, of the forms compensating arm structure side portions of the upper portion 146 thereof (FIG. 5). The side plates 120 and 122 also include the bearings 170 and 172 (FIG. 6) for carrying the cam member 164 as well as the slots for guiding the platen carrier 152.

Figure 7:
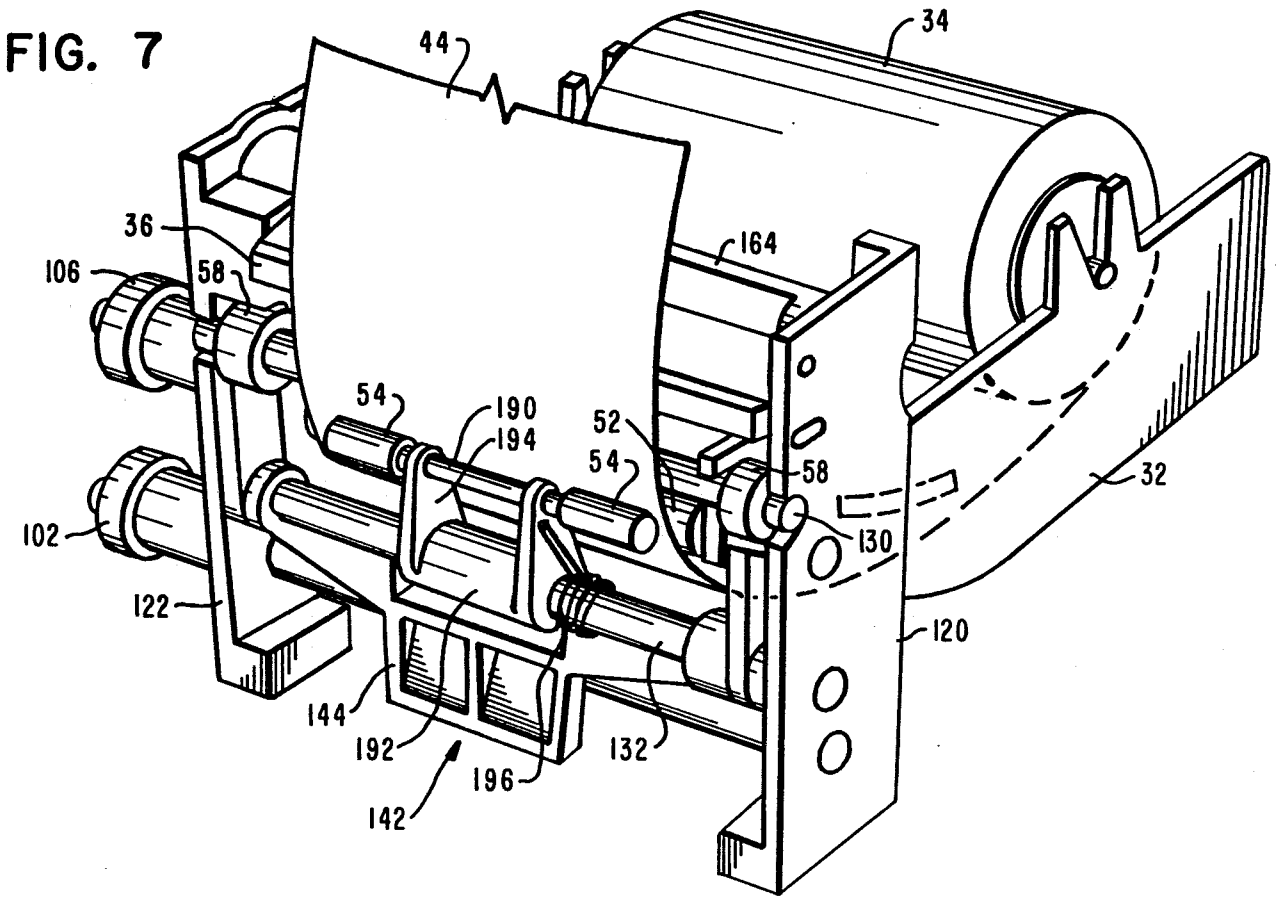
FIG. 7 is a perspective view of the receipt module of the printer of FIG. 1.

FIG. 7 shows a perspective view of the various parts of the receipt module 32 wherein receipt paper 44 is taken from the supply roll 34 and is directed into a path to be advanced upwardly in front of the platen 36 by the drive roller 52 and the idler rollers 54. The idler rollers 54 are carried by a shaft 190 supported in a cradle that includes a journal portion 192 and upright portions, as 194. The journal portion is carried by the pivot shaft 132 and the entire idler roller assembly is biased by coil springs, as 196, to provide surface contact of the rollers 54 with the feed roll 52 (FIG. 5).

It should be noted and is seen in FIG. 7 that the slip feed pressure rolls 58 on the shaft 130 are spaced wider than the receipt paper 44, the receipt feed roll 52, and also wider than the idler rollers 54. This construction allows the receipt paper 44 to be fed or advanced independently from the slip or form 46 and the slip or form to be fed or advanced independently from the receipt paper by reason of the positioning of the various parts and of the paths taken by the receipt paper 44 and by the slip or form 46 past the printing station. The positions of the feed rolls 52 and 54 for the receipt paper 44 and of the feed rolls 56 and 58 for the form 46 allow the feed rolls to be located relatively close to the common platen 36.

Figure 8:
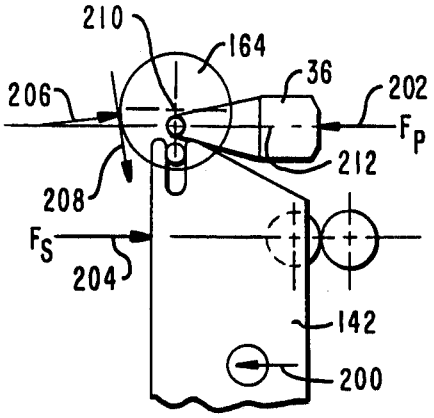
FIG. 8 is a view showing the forces acting on the forms compensating mechanism.
Figure 9:
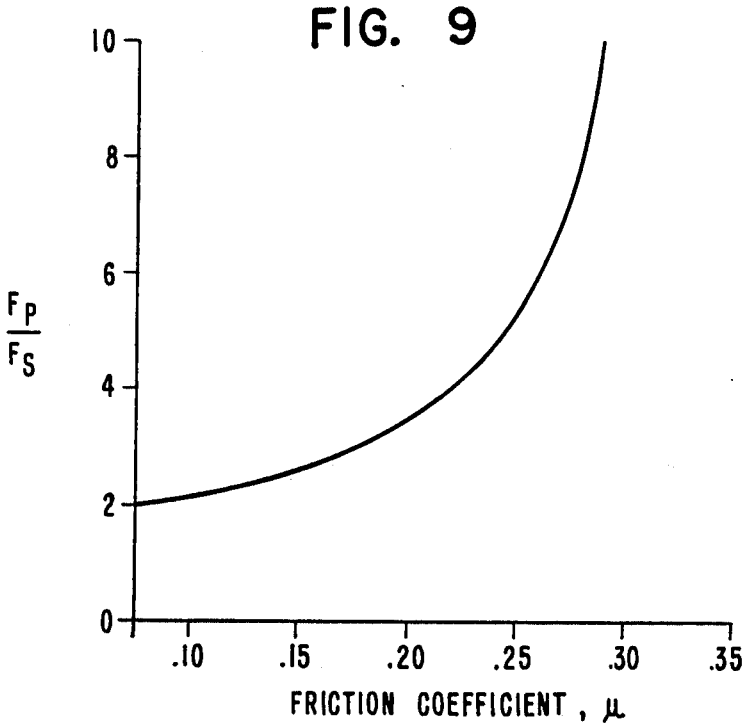
FIG. 9 is a graph showing the effect of the coefficient of friction between the eccentric members and the side plates of the printer on the magnitude of print impact force that can be resisted by the spring loaded forms compensating mechanism.

FIG. 8 illustrates the several forces acting on the platen 36 and its associated parts such as the forms compensation arm structure 142 and the cam member 164. Arrow 200 is the forms compensating arm pivot reaction force and arrow 202 is the print force exerted by the print head 22. The force illustrated by arrow 204 is an equivalent force exerted by the extension springs 141 which couple the forms compensating arm 142 and the side plates 120 and 122. An eccentric reaction force is indicated by the arrows 206 and 208 wherein the effect of friction between the cam member 164 and the bearings 170 and 172 is computed and shown by the curve of FIG. 9. FIG. 8 also shows the off-center or displacement of the center 210 of the cam member 164 from the centerline 212 of the platen 36 in the fore and aft direction of travel thereof relative to the print head 22. The curve of FIG. 9 illustrates a relationship between the print force $F_p$/spring force $F_5$ ratio and the coefficient of friction between the ends of the cam member 164 and the bearings 170 and 172 and also illustrates the self-locking nature of the mechanism with regard to resisting print forces 202 (FIG. 8). The materials utilized in the present embodiment have a coefficient of friction in the range from 0.11 to 0.24.

In the operation of the forms compensating mechanism of the present invention, it is desirable that the mechanism accommodate record media 46 of different thicknesses and also provide a firm support for the media during the printing operation. In this regard, the thickness of the record media 46 determines the gap or opening between the platen 36 and the print head 22. It is noted that the best operating characteristics of the print head 22 to obtain quality printing are maintained by keeping the print head-to-media gap constant or by decreasing the gap in proportion to the media thickness. A preferred arrangement is to decrease the gap, as illustrated by the arrows 68 and 70 in FIG. 3, by 40 percent of the thickness of the inserted form.

It is seen from FIG. 4 that clockwise rotation of the step motor 80, motor shaft 84 and pinion 82 rotates gear 86 counterclockwise and rotates gear 90 clockwise which, in turn, rotates input gear 102 counterclockwise. Counterclockwise rotation of gear 86 rotates gear 88 clockwise which, in turn, rotates input gear 106 counterclockwise.

As mentioned above, the one-way clutches 180 and 182 (FIG. 6) are provided on the shafts 108 and 104, respectively, with the clutches being press fitted into the hubs of the input gears 106 and 102. The one-way clutch 180 is oriented such that counterclockwise rotation of input gear 106 engages the clutch 180 on the shaft 108 and drives the receipt feed roller 52 in a counterclockwise direction to feed the receipt paper 44 in an upward direction past the printing station. Conversely, clockwise rotation of the input gear 106 disengages the clutch 180 from the shaft 108 and over-runs on such shaft.

The one-way clutch 182 is oriented such that clockwise rotation of the input gear 102 engages the clutch 180 on the cam shaft 104 and drives the cam member 140 clockwise to engage the forms compensating arm portion 144 and to pivot the arm assembly 142 in a counterclockwise direction around the pivot shaft 132. Conversely, counterclockwise rotation of the input gear 102 disengages the clutch 182 from the shaft 104 which then over-runs such shaft. It is, therefore, seen that clockwise rotation of the step motor 80 rotates both input gears 102 and 106 counterclockwise which causes the receipt paper 44 to be fed upwardly through the printing station, and counterclockwise rotation of the step motor 80 rotates both input gears 102 and 106 clockwise which causes the forms compensating mechanism cam line comprising the shaft 104 and the cam member 140 to rotate clockwise and to pivot the arm assembly 142 in a counterclockwise direction.

The single step motor 80 provides the drive for two functions in the operation of the printer. The receipt paper 44 is fed between the rubber feed roller 52 and the metallic pressure rollers 54 to provide the necessary means to feed the paper upon counterclockwise rotation of the gear 106 and the shaft 108. The metallic pressure rollers 54 are free to rotate in the mounting on the pressure arm 192 which is journaled on and free to rotate on the pivot shaft 132. The torsion springs 196 which are mounted adjacent the pressure arm 192 on the pivot shaft 132 each have one end which acts against the pressure arm 192 and the other end which acts against the arm assembly 142 to provide the force against the receipt paper 44. It is also noted that the gear ratio between the motor pinion 82 and the gear 106 relative to the diameter of the receipt paper feed roller 52 is designed so that a motor 80 step of 7.5 degrees advances the receipt paper 44 an amount equal to the vertical dot pitch of the dot matrix.

The slip or form 46 feed mechanism comprises the forms compensating arm assembly 142, the pressure roll 58, the feed rolls 56, the extension springs 141 and the drive gears 112 and 114. The extension springs 141 provide a constant pull on the arm assembly 142 in the clockwise direction so that the pressure rolls 58 are forced against the rubber feed roller 56 to provide the necessary contact to feed the slip or form 46 upwardly past the printing station. The feed roller 56 is driven by a step motor through an appropriate gear train (not shown). As with the receipt paper drive, the gear ratios relative to the diameter of the feed roller 56 are designed so that a motor step of 7.5 degrees advances the slip or form 46 an amount equal to the vertical dot pitch of the dot matrix. The feed roller 56 is rotated in the clockwise direction to drive the slip or form upwardly past the print station. Since the forms compensating arm assembly 142 is loaded by the springs 141, forms of different thicknesses can be accommodated by the structure of the present invention without appreciably changing the clamping pressure, although a slight increase thereof will be apparent with increasing form thickness.

The pressure rolls 58 are retracted approximately 0.09 inches for insertion of a slip or form 46 by rotating the arm assembly 142 in a counterclockwise direction. This rotation is accomplished by rotating the cam shaft 104 and the cam member 140 clockwise (through counterclockwise rotation of the step motor 80) until the cam follower or lower portion 144 of the arm assembly 142 is on the high lobe or point of the cam member. When the arm assembly 142 is pivoted to this retracted position, the step motor 80 is turned off and the arm assembly 142 will stay in such position on the high lobe of the cam member 140 until a form 46 is inserted into the slot 42 and the step motor is turned on to continue rotation of the cam member 140 in the clockwise direction back to the home or closed feed roller 56 and pressure rollers 58 position. At the home or closed position of the feed roller 56 and pressure rollers 58, there is a clearance between the cam member 140 and the cam follower or lower portion 144 of the arm assembly 142 thereby allowing the extension springs 141 to develop full clamping force at the feed and pressure rollers. An interrupter sensor 212 located under the cam shaft 104 and operating in conjunction with a timing disk 214 attached to the cam shaft is used to determine the closed or home position and also the open or feed position of the feed roller 56 and pressure rollers 58. It is seen that the pressure rollers 58 can be maintained in the retracted position for insertion of a slip or form 46 without the application of electrical power.

Compensation for forms of different thicknesses is accomplished by converting rotational motion and pivoting of position of the arm assembly 142 to linear motion and translation of the position of the platen 36. It is seen that rotation of the arm assembly 142 or pivoting thereof on pivot shaft 132 causes the cam member 164 to rotate in the bearings 170 and 172 of the side plates 120 and 122 of the receipt module 32 about the center 174 of the cam member 164, which action causes linear movement of the platen 36 in a direction to and from the print head 22. The kinematic relationship of the forms compensating mechanism and arrangement is designed so that the amount of platen motion is approximately 60 percent of the amount of motion of the forms compensating arm assembly 142, such latter motion being the horizontal component of motion of the pressure rollers 58. An example of this arrangement indicates that if a slip or form of T thickness is placed between the feed roller 56 and the pressure rollers 58, the platen 36 will be retracted back from the print head 22 by an amount of 60 percent of the thickness T which amount maintains an optimum distance between the print head 22 and the record media or form 46.

The bearing diameter of the cam member 164 is designed to be sufficiently large to induce a self-locking effect on the forms compensating mechanism with regard to impact forces generated on the face of the platen 36 by the print head 22. It is seen that a relatively large force applied on the face of the platen 36 can be resisted by the relatively low force of the extension springs 141 due to the frictional reaction forces generated by the bearings 170 and 172 acting on the ends of the cam member 164.

In the operation of the slip stop 62, when the platen 36 is in the forward or print position, the slip stop and its carrier are in the retracted position or away from the path of the slip 46. When the slip pressure rollers 58 and the platen 36 are retracted for insertion of the slip 46, the cam member 164 rotates in a clockwise direction and thereby moves the stop 62 and its carrier forward to the position where the stop is placed in the path of the slip. When the slip or form 46 is inserted from the front of the printer through the slot or throat 42 (FIG. 2) below the slip stop 62, the slip 46 will contact the bottom surface of the slip stop 62 and be stopped in a position which establishes a reference position for the slip or form 46 for printing the first line thereon.

In the case where the slip or form 46 is inserted from the side of the printer, the slip stop 62 must be overcome so that the slip 46 engages the beveled or slanted surface 64 on the left front of the slip stop and the slip stop 62 will be forced rearward to allow the form 46 to be positioned in the desired printing position. Where the slip or form 46 is inserted from the top of the printer, the slip engages the beveled or slanted surface 66 on the top front of the slip stop 62 and the stop will be forced rearward to allow the slip 46 to be moved down to the desired printing position. When the pressure rollers 58 are now closed against the inserted slip or form 46, the slip stop 62 is retracted to accommodate the thickness of the slip. The reflective sensor 60 (FIGS. 2 and 6) of the LED type is positioned at a location adjacent the slip or form guide 218 at the right hand side of the printing station and under the pressure rollers 58 to detect an inserted slip or form 46 whereupon the rollers 58 can be closed against the slip or form 46 and the printing operation can be accomplished.

It is thus seen that herein shown and described is a record media thickness compensating mechanism which provides rotatable means to accommodate the record media and platen carrier means coupled thereto for the printing operation. The mechanism and arrangement enable the accomplishment of the objects and advantages mentioned above, and while a preferred embodiment of the invention has been disclosed herein, variations thereof may occur to those skilled in the art. It is contemplated that all such variations not departing from the spirit and scope of the invention hereof are to be construed in accordance with the following claims.

What is claimed is:

1. Record media thickness compensating mechanism for use in a printer having a frame with spaced side plates, a driving roller and a driven roller, and an operating print head, the mechanism comprising an arm assembly extending substantially across and occupying space between said side plates and pivotally supported from the side plates of the printer, sensing means for sensing record media inserted in said printer, platen means having a centerline and positioned opposite said print head and coupled with said arm assembly to move the platen means relative to said print head upon pivoting of said arm assembly, first motor-driven camming means journaled in said side plates and engageable with said arm assembly for pivoting thereof, and second rotatable camming means coupled to said arm assembly and operably associated with said platen means and bearing on the side plates of said printer frame, the axis of rotation of said second camming means being positioned off-center relative to the centerline of said platen means wherein driving of said first camming means causes pivoting of said arm assembly which in turn causes rotation of said second camming means to move said platen means in a linear direction away from said print head to permit insertion of the record media between the print head and the platen means, said first camming means and said second camming means enabling movement of said platen means in a direction toward said print head for a distance dependent upon the thickness of record media inserted between said driving roller and said driven roller and sensed by said sensing means.

2. The mechanism of claim 1 including resilient means coupling said printer frame and said arm assembly for biasing said platen means in a direction toward said print head.

3. The mechanism of claim 1 wherein said printer frame includes guide means for directing said platen means in a path to and from the print head.

4. The mechanism of claim 1 wherein the second camming means comprises a rotatable member coupled with said platen means and wherein rotation of said member causes said platen means to be moved in a linear direction to and from the print head.

5. The mechanism of claim 1 wherein said arm assembly includes a lower portion engageable with said first camming means and an upper portion coupled with said second camming means for pivoting of said arm assembly and causing linear movement of said platen means.

6. The mechanism of claim 1 wherein said arm assembly includes slot means therein and said second camming means includes pin means operating in said slot means for rotating said second camming means upon pivoting of said arm assembly.

7. The mechanism of claim 1 wherein the second camming means comprises a generally cylindrical member bearing on said printer frame and having a center of rotation spaced from the centerline of the platen means to effect linear motion of said platen means upon pivotal motion of said arm assembly and rotational motion of said second camming means.

8. A printer having a print head and a platen movable along a centerline of the platen in opposed manner relative to the print head, means including a driving roller and a driven roller for advancing record media past a printing station formed by the print head and the platen, and means supported from spaced side plates of the printer for compensating for different thicknesses of record media comprising an arm assembly extending substantially across and occupying space between said side plates and pivotally supported from the side plates of the printer, said arm assembly providing rotational support for said driven roller, sensing means for sensing record media inserted in the printer, a support assembly of generally U-shaped configuration for carrying the platen, said platen being coupled with said arm assembly to move the platen relative to the print head upon pivoting of said arm assembly, first rotatable cam means journaled in said side plates and engageable with said arm assembly for pivoting thereof, second rotatable cam means operably coupled with said platen support assembly and bearing on the side plates of said printer, and linkage means coupling the arm assembly and the second cam means for rotation of said second cam means upon pivoting of said arm assembly, the axis of rotation of said second cam means being positioned off-center relative to the centerline of said platen wherein rotation of said first cam means causes pivoting of said are assembly and rotation of said second cam means to move said platen in a linear direction to and from said print head to permit insertion of said record media between the print head and the platen, said first cam means and second cam means enabling movement of said platen in a direction toward said print head for a distance dependent upon the thickness of record media inserted between said driving roller and said driven roller and sensed by said sensing means.

9. The printer of claim 8 including resilient means coupling said printer and said arm assembly for biasing said platen in a direction toward said print head.

10. The printer of claim 8 wherein said printer includes guide means for directing said platen in a linear path to and from the print head.

11. The printer of claim 8 wherein the second cam means comprises a rotatable member coupled with said platen and wherein rotation of said rotatable member causes said platen to be moved in said linear direction.

12. The printer of claim 8 wherein said linkage means coupling the arm assembly and the second cam means comprises a pin and slot connection.

13. The printer of claim 8 including a pin and slot connection coupling said second cam means and said platen.

14. The printer of claim 8 wherein the second cam means comprises a generally cylindrical member bearing on said printer and having a center of rotation spaced from the centerline of the platen to effect such linear motion of said platen upon pivoting of said arm assembly and upon rotation of said second cam means.

15. In a printer having spaced side plates and a print head movable along a platen at a line of printing, means including a driving roller and a driven roller for advancing record media past the line of printing, a platen support assembly of generally U-shaped configuration for carrying the platen and movable along a centerline of the platen in a direction to and from the print head, the improvement comprising an arm assembly extending substantially across and occupying space between said side plates and pivotally supported from the side plates of the printer, said platen support assembly being coupled with said arm assembly to move the platen relative to the print head upon pivoting of the arm assembly, said arm assembly providing rotational support for said driven roller, first rotatable cam means journaled in said side plates and engageable with the arm assembly for pivoting thereof, second rotatable cam means bearing on the side plates of said printer and operable coupled with said platen support assembly, first linkage means coupling the arm assembly and the second cam means at the ends thereof for rotation of said second cam means upon pivoting of said arm assembly, and second linkage means coupling the second cam means and the platen support assembly at the ends thereof, the axis of rotation of said second cam means being positioned off-center relative to the centerline of said platen whereby rotation of said first cam means causes pivoting of said arm assembly and rotation of said second cam means to move said platen in a linear direction to and from said print head to permit insertion of the record media between the print head and the platen, the amount of movement of the platen is said linear direction being dependent upon the thickness of the record media inserted between said driving roller and said driven roller.

16. In the printer of claim 15 wherein said spaced side plates include bearing portions for receiving said second cam means and having a centerline positioned in offset manner from the centerline of the linear direction of travel of the platen to and from the print head.

17. In the printer of claim 16 wherein the second cam means is a generally cylindrical member journaled in said bearing portions and rotatable about a center spaced from the centerline of the platen.

18. In the printer of claim 15 wherein the first and second linkage means each comprise pin and slot connections in the second cam means and the arm assembly, and in the second cam means and the platen support assembly, respectively.

* * * * *